US006986355B2

(12) United States Patent
Byun

(10) Patent No.: US 6,986,355 B2
(45) **Date of Patent: *Jan. 17, 2006**

(54) COSMETIC CASE OF BUTTON OPEN TYPE

(76) Inventor: Young Kwang Byun, MokdongSinsigaji Apt. 928-1005, 312, Shinjung-dong, Yangchun-gu, Seoul (KR)

( * ) Notice: Subject to any disclaimer, the term of this patent is extended or adjusted under 35 U.S.C. 154(b) by 173 days.

This patent is subject to a terminal disclaimer.

(21) Appl. No.: 10/640,706

(22) Filed: Aug. 14, 2003

(65) Prior Publication Data

US 2005/0172981 A1 Aug. 11, 2005

(30) Foreign Application Priority Data

Mar. 17, 2003 (KR) ..... 10-2003-0016466

(51) Int. Cl.
*A45D 33/20* (2006.01)

(52) U.S. Cl. ..... 132/287; 132/294

(58) Field of Classification Search ..... 132/287, 132/294; 206/581; 220/254.5, 264, 292, 220/823, 827; 16/255, 303, 301
See application file for complete search history.

(56) References Cited

U.S. PATENT DOCUMENTS 5,762,216 A * 6/1998 Takeuchi ..... 215/235
2004/0200497 A1 * 10/2004 Thorpe et al. ..... 132/287
2004/0221866 A1 * 11/2004 Greenfield ..... 132/287
2005/0011806 A1 * 1/2005 Byun ..... 206/581

* cited by examiner

*Primary Examiner*—John J. Wilson
*Assistant Examiner*—Robyn Doan
(74) *Attorney, Agent, or Firm*—Bell, Boyd & Lloyd LLC

(57) ABSTRACT

A cosmetic case of button open type is disclosed. The cosmetic case includes: a main case (1) made of a box type board and having an opening path formed in a side surface; a make-up case (21) having partitions (25) for containing cosmetics of various kinds; a cover (30) for covering the top portion of the make-up case (21) and coupled to the main case (1); a receiving drawer (40) being in the form of a rectangle, and having partitions (25) for providing a receiving space for receiving make-up tools and a slider (41) mounted on the outer side surface; hinge shafts (50) inserted into shaft holes (15) formed in both sides of the cover (30) for hinging the cover (30) to the main case (1); and an elastic member (51) mounted on the outer side surface of the main case (1) and elastically compressed by the cover (30) to rotate and open the cover (30). When a user pushes the receiving drawer (40) containing the make-up tools, the cover (30) is opened in a one-touch manner, so that the user can take out the cosmetics and make-up tools. The cosmetic case can receive and contain the cosmetics and make-up tools of various kinds.

21 Claims, 10 Drawing Sheets

COSMETIC CASE OF BUTTON OPEN TYPE

BACKGROUND OF THE INVENTION

1. Field of the Invention

The present invention relates to a cosmetic case of button open type, and more particularly, to a cosmetic case of button open type which can receive color tone cosmetics and brushes of various kinds used for applying make-up to cheeks and around eyes, in one case, and which can easily carry along with it and safekeep it owing to its small volume.

2. Background of the Related Art

In general, a cosmetic case includes a case body, a cover pivotally connected to the case body and opened and closed through rotation, and a space for receiving cosmetics inside. Women, who have professional careers, such as models, performers and the likes, have to repeatedly do a series of actions for applying and removing make-up of various kinds or to change colors of the make-up according to environments or atmosphere, and so they have to carry along a great deal of cosmetics of various kinds. However, the conventional cosmetic cases have several disadvantages in that they are too heavy and have a small receiving space.

To solve the above problems, Korean Utility Model Registration No. 217612 discloses a portable cosmetic case (hereinafter, referred to as "cited reference 1"), and Korean Utility Model Registration No. 194904 discloses a cosmetic case (hereinafter, referred to as "cited reference 2").

The main feature of the cited reference 1 is that the cosmetic case has a form similar to a collapsible purse, so that a blocking plate covers a receiving plate having a receiving groove for receiving cosmetics and an elongated groove for seating a brush to prevent mixture of cosmetics of various kinds stored in the receiving plate. Therefore, users can carry lots of cosmetics. However, the cited reference 1 has several disadvantages in that there is difficulty to fold and unfold the receiving plate to use the cosmetics, in that powdered cosmetics may be discharged to the outside when the cosmetic case is folded, and in that the outside of the cosmetic case is made of leather as purses so as to increase manufacturing expenses.

The cited reference 2 includes a case body, a cover, a slidable cover, and a drawer. The case body has a groove for seating a puff and another groove for putting compressed powder. The groove of the case body is covered with the cover hinged with the case body and the slidable cover slidably connected with the side surface of the case body. The drawer is slidably connected to the inside of the lower portion of the case body. The cited reference 2 further includes a puff receiving space formed by dividing the cosmetic case into two, and a slidable powder cover for providing convenience in opening the cosmetic case. It is considered that the drawer slidable connected to the inside of the lower portion of the case body and having a space for receiving the cosmetics and make-up tools can receive and contain cosmetics and make-up tools of various kinds. However, the cited reference 2 also has several disadvantages in that the user must open the covers one by one and draw out the drawer for more various and different make-up. Furthermore, the cited reference 2 can receive and contain the cosmetics and make-up tools of various kinds, but has another disadvantage in that it does not provide a sufficient receiving space for people who have professional careers, such as models, performers and the likes, requiring make-up of various kinds suitable for various circumstances.

SUMMARY OF THE INVENTION

Accordingly, the present invention is directed to a cosmetic case of button open type that substantially obviates one or more problems due to limitations and disadvantages of the related art.

An object of the present invention is to provide a cosmetic case of button open type, which can provide a user with convenience by opening covers and receiving drawers at a time when the user pushes a button formed on the front surface thereof or a side surface thereof, secure a sufficient receiving space by providing double receiving drawers, and provide convenience in carrying along with it by making receiving drawers and the case compact.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the cosmetic case of button open type includes: a main case made of an integrated board surrounding all directions so that the lower portion is closed and the upper portion is opened, the main case having an opening path formed on a side surface thereof, a horizontally straight guide slot formed in the front surface of the inside thereof, a locking groove formed in the upper surface of the board, which is the front surface of the main case, so as to be vertically connected with the guide slot, a coupling groove recessed inwardly from the central portion of the plate, which is the rear surface of the inside, shaft holes formed in both sides of the side portions, and a seating step formed on the upper surface of the board surrounding the all directions; a make-up case having a flange corresponding to the shape of the seating step of the main case, and partitions formed integrally with the flange for receiving cosmetics of various kinds; a cover having shaft holes to be hinged with the shaft holes of the main case, a coupling plate corresponding to the coupling groove of the main case, the coupling plate having a concave portion formed on the center and having inclined surfaces formed on both sides thereof, a cover plate being at a right angle to the coupling plate, and a stopper being at a right angle to the cover plate and fit into the locking groove of the main case, the stopper having a locking jaw formed on the lower end thereof; a receiving drawer of a rectangular drawer type, the receiving drawer having partitions for forming a receiving space to receive make-up tools, a sliding stop step slidably inserted into the guide slot of the main case and caught to the side surface of the stopper, and a slider mounted on the outer side surface and having a cover stop step for locking the locking jaw of the stopper; hinge shafts inserted into the shaft holes of the side portions of the main case and the shaft holes of both sides of the coupling plate of the cover for hinging the cover to the main case; an elastic member mounted on the outer surface of the main case, the elastic member being elastically compressed by the concave portion of the coupling plate of the cover to rotate and open the cover when a user pushes a button; and a coil spring for providing elasticity between the inner surface of the main case and the side surface of the receiving drawer so that the receiving drawer is bounced out of the main case.

In another aspect of the present invention, the cosmetic case of button open type includes: a main case made of an integrated board case surrounding all directions so that the lower portion is closed and the upper portion is opened, the main case having an opening path formed on a side surface, a horizontally straight guide slot formed in the front surface of the inside thereof, a coupling groove recessed inwardly from the central portion of the board, which is the rear surface of the inside, shaft holes formed in both sides of the side portions, and a seating step formed on the upper surface of the board surrounding the all directions; a make-up case having a flange corresponding to the shape of the seating step of the main case, and partitions formed integrally with the flange for receiving cosmetics of various kinds; a receiving drawer of a rectangular drawer type, the receiving drawer having partitions for forming a receiving space to receive make-up tools, and a slider formed on the outer side surface and slidably moving under a state in which the slider is inserted into the guide slot of the main case, the slider having a locking groove; a cover having shaft holes to be hinged with the shaft holes of the main case, a coupling plate corresponding to the coupling groove of the main case, the coupling plate having a concave portion formed on the center and having inclined surfaces formed on both sides, a cover plate being at a right angle to the coupling plate and having the protruding circumference, and a stopper being at a right angle to the cover plate, the stopper having a locking jaw to be fixed to the lower end of the locking groove of the receiving drawer; a button panel hinged to the center of the main case, the button panel having a protrusion formed on the front surface and a push hole formed in the rear surface, the lower end of the stopper being inserted into the push hole, the push hole pushing up the stopper by rotation to separate the stopper from the locking groove of the receiving drawer; hinge shafts inserted into the shaft holes of the side portions of the main case and the shaft holes of both sides of the coupling plate of the cover for hinging the cover to the main case; an elastic member mounted on the outer surface of the main case to rotate and open the cover, the elastic member being elastically compressed by the concave portion of the coupling plate of the cover; and a coil spring for providing elasticity between the inner surface of the main case and the side surface of the receiving drawer so that the receiving drawer is bounced out of the main case.

In a further another aspect of the present invention, the cosmetic case of button open type includes: a main case made of an integrated board case surrounding all directions so that the lower portion is closed and the upper portion is opened, the main case having an opening path formed on a side surface thereof, a coupling groove recessed inwardly from the central portion of the board, which is the rear surface of the inside, shaft holes formed in both sides of the side portions, and a seating step formed on the upper surface of the board surrounding the all directions; a cover having shaft holes to be hinged with the shaft holes of the main case, a coupling plate corresponding to the coupling groove of the main case, the coupling plate having a concave portion formed on the center and having inclined surfaces formed on both sides, a cover plate being at a right angle to the coupling plate and having the protruding circumference, and a stopper being at a right angle to the cover plate and having a locking jaw; a make-up case having a flange corresponding to the shape of the seating step of the main case, and partitions formed integrally with the flange for receiving cosmetics of various kinds; a receiving drawer made of board, the receiving drawer having partitions for forming a receiving space to receive make-up tools, and a locking groove formed on the side surface for fixing the cover by fitting the locking jaw of the stopper of the cover into the locking groove; a button panel hinged to the center of the main case, the button panel having a protrusion formed on the front surface and a push hole formed in the rear surface, the lower end of the stopper being inserted into the push hole, the push hole pushing up the stopper by rotation to separate the stopper from the locking groove of the receiving drawer; hinge shafts inserted into the shaft holes of the side portions of the main case and the shaft holes of both sides of the coupling plate of the cover for hinging the cover to the main case; and a coil spring for providing elasticity between the inner surface of the main case and the side surface of the receiving drawer so that the receiving drawer is bounced out of the main case.

It is preferable that a subsidiary case opened at the front is mounted under the main case, the subsidiary case having protrusions formed on the inner side surfaces and a rounded groove formed on the outer surface, the subsidiary case including a receiving space divided by partitions to contain cosmetics and brushes of various kinds, an opening step formed on the front surface for allowing the user to easily pull out the subsidiary case with hand, and a subsidiary receiving drawer slidably moving inside the subsidiary case and having protrusions locked to the protrusions of the subsidiary case.

The cosmetic case of button open type further includes: a hole formed in the bottom surface of the main case to communicate with the lower portion of the main case; a locking panel formed on the bottom board of the receiving drawer, the locking panel being inserted into the hole of the main case and protruding downwardly; a subsidiary case connected to the lower surface of the main case, the subsidiary case having an inner space and an opening path formed axially and having protrusions on the side surfaces; a subsidiary receiving drawer seated inside the space of the subsidiary case and slidably moving along the opening path, the subsidiary receiving drawer having a receiving space divided by partitions so as to have receiving spaces axially arranged in a line and another receiving space for receive a brush, semicircle protrusions to be locked to the protrusions of the subsidiary case, a button protruding from the side surface, and a pickup groove formed in the front board, the subsidiary receiving drawer being supported to the locking panel of the receiving drawer and restricted inside the space of the subsidiary case; and a coil spring mounted on the side surface of the subsidiary receiving drawer to provide elasticity so that the subsidiary receiving drawer is bounced to the outside together with the receiving drawer.

It is preferable that the receiving drawer has a receiving cover hinged to the partition and the upper portion of the side board to open and close a part of the receiving space.

It is preferable that the partition and the side board forming the receiving space of the receiving drawer respectively have pickup grooves for allowing the user to easily pick up make-up tools, and the receiving space has a semicircle hole to put a rounded article.

It is preferable that the main case has protrusions formed on both sides of the opening path, and the receiving drawer has semicircle protrusions formed on both outer sides of the receiving drawer to be locked to the protrusions formed on the main case.

It is preferable that the cover plate of the cover has a mirror.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
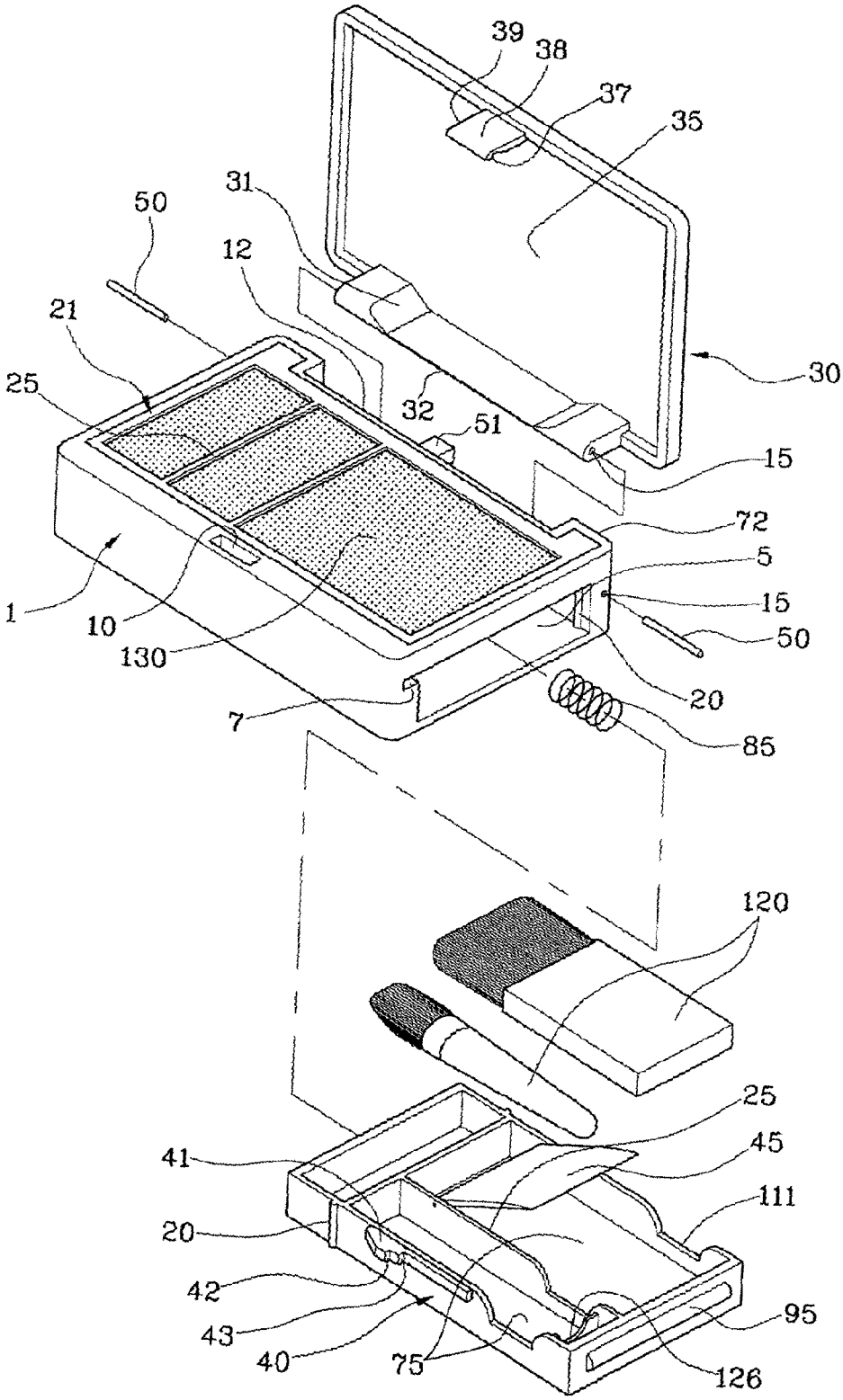
FIG. 1 is an exploded perspective view of a cosmetic case of button open type according to a first preferred embodiment of the present invention.

Reference will now be made in detail to the preferred embodiments of the present invention, examples of which are illustrated in the accompanying drawings.

A cosmetic case of button open type according to the present invention includes a main case 1, 52, or 60, a make-up case 21 mounted on the upper portion of the main case 1, a cover 30 for covering the make-up case 21, a receiving drawer 40, 53 or 61 for opening and closing the main case, and a coil spring 85, a button panel 59 and an elastic member 51 for pushing out the receiving drawer 40, 53 or 61.

Figure 2:
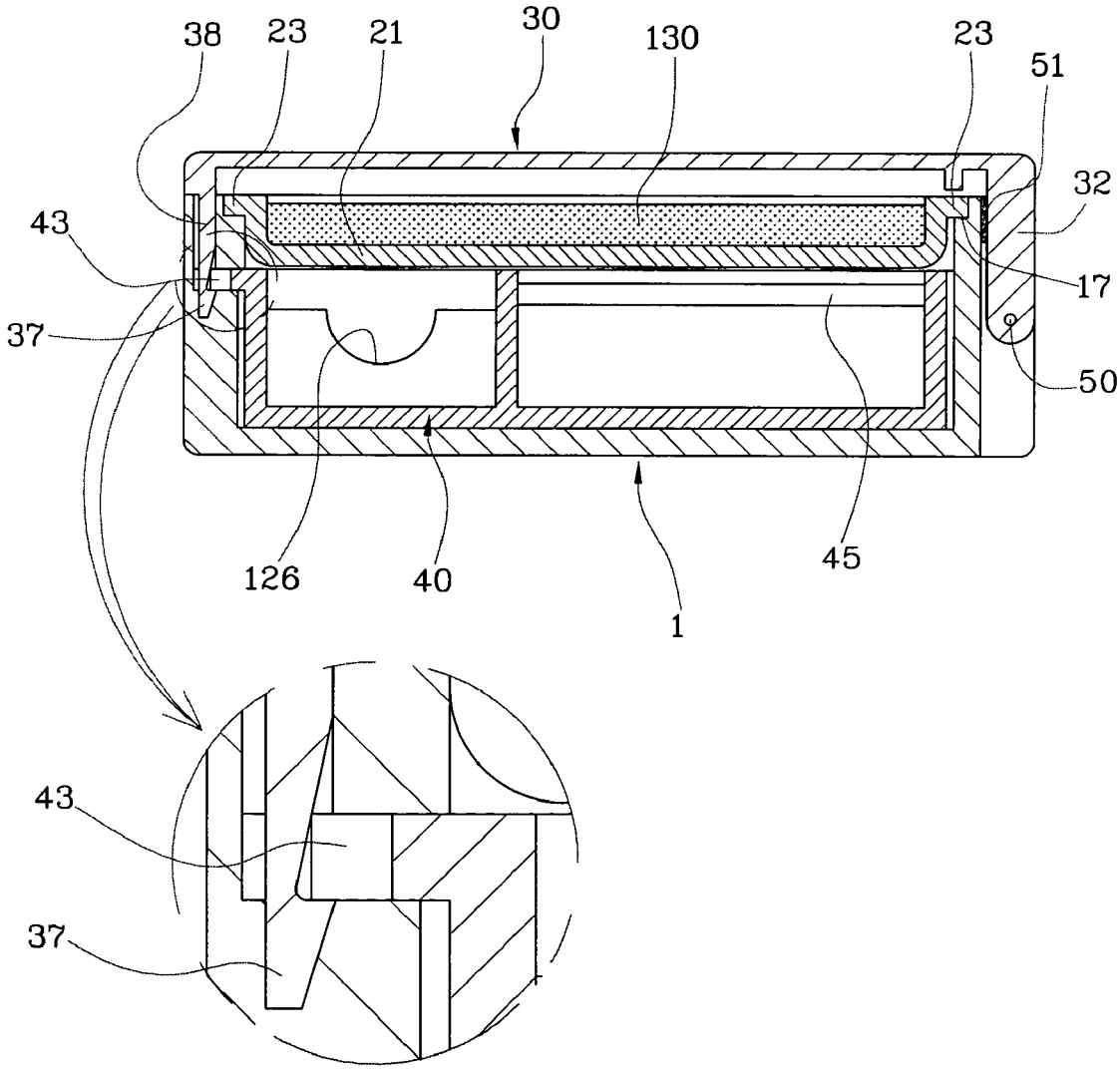
FIG. 2 is a horizontally sectional view of the cosmetic case of button open type according to the first embodiment of the present invention.

Referring to FIGS. 1 and 2, the structure of the cosmetic case according to a first embodiment of the present invention will be described in more detail.

As shown in FIG. 1, the main case 1 is made of an integrated board surrounding all direction so that the lower portion is closed and the upper portion is opened, and includes an opening path 5 formed on a side surface thereof for opening and closing the receiving drawer 40, protrusions 20 formed on both inner side surfaces, a horizontally straight guide slot 7 formed in the front surface of the inside thereof, a locking groove 10 formed on the upper surface of the board, which is the front surface of the main case, the locking groove 10 being connected at a right angle to the guide slot 7, a coupling groove 12 formed in the center of the board, which is the rear surface of the inside of the main case 1 and recessed inwardly from side portions 72, shaft holes 15 formed in both sides of the side portions 15, and a seating step 17 formed on the upper surface of the board surrounding the all directions.

As shown in FIG. 2, the make-up case 21 attached to the upper portion of the main case 1 includes a flange 23 corresponding to the shape of the seating step 17 of the main case 1, and partitions 25 formed integrally with the flange 23 for receiving cosmetics 130 of various kinds. It would be appreciated that the number and shape of the partitions 25 can be changed according to the amount and kinds of the cosmetics, and the size of brushes.

The cover 30 includes shaft holes 15 to be hinged with the shaft holes 15 of the main case 1, a concave portion formed in the center and having inclined surfaces 31 formed on both sides, a coupling plate 32 corresponding to the coupling groove 12 of the main case 1, a cover plate 35 being at a right angle to the coupling plate 32 and having the protruding circumference, and a stopper 38 being at a right angle to the cover plate 35 and fit into the locking groove 10 of the main case 1, and having a locking jaw 37 formed on the lower end thereof.

The receiving drawer 40 of a rectangular drawer type includes partitions 25 for forming a receiving space 75 to receive make-up tools, a sliding stop step 42 slidably inserted into the guide slot 7 of the main case 1 and locked to the side surface of the stopper 38, and a slider 41 mounted on the outer side surface and having a cover stop step 43 for locking the locking jaw 37 of the stopper 38. Furthermore, semicircle protrusions 20 are formed on both sides of the receiving drawer 40 to be locked to the main case 1.

Additionally, the receiving drawer 40, 53 or 61 further includes pickup grooves 111 formed in the partitions 25 and the side plate forming the receiving space 75 for allowing a user to easily pick up the make-up tools, and a rounded groove 126 formed in the receiving space 75 for seating rounded articles, such as a grip of a make-up brush 120.

The coil spring 85 is mounted on the side surface of the receiving drawer 40 or inside the main case 1, so that the locking between the locking jaw 37 of the stopper 38 and the cover stop step 43 of the receiving drawer 40 is released when the user pushes the button 95 of the receiving drawer 40, and the locking between the sliding stop step 42 of the receiving drawer 40 and the side surface of the stopper 38 is released by rotation and lifting of the cover 30. As a result, the receiving drawer 40 is bounced out of the main case 1.

Hinge shafts 50 are inserted into the shaft holes 15 of the side portions 72 of the main case 1 and the shaft holes 15 formed in both sides of the coupling plate 32 of the cover 30 so as to hinge the cover 30 to the main case 1.

An elastic member 51 is mounted on the rear surface of the main case 1 in such a manner that the elastic member 51 is elastically compressed by the concave portion of the coupling plate 32 of the cover 30 when the user pushes the button 95 under the state in which the stopper 38 of the cover 30 is locked to the slider 41 of the receiving drawer 40 and covers the top portion of the main case 1, and thereby, the cover 30 is rotated and opened.

Figure 3:
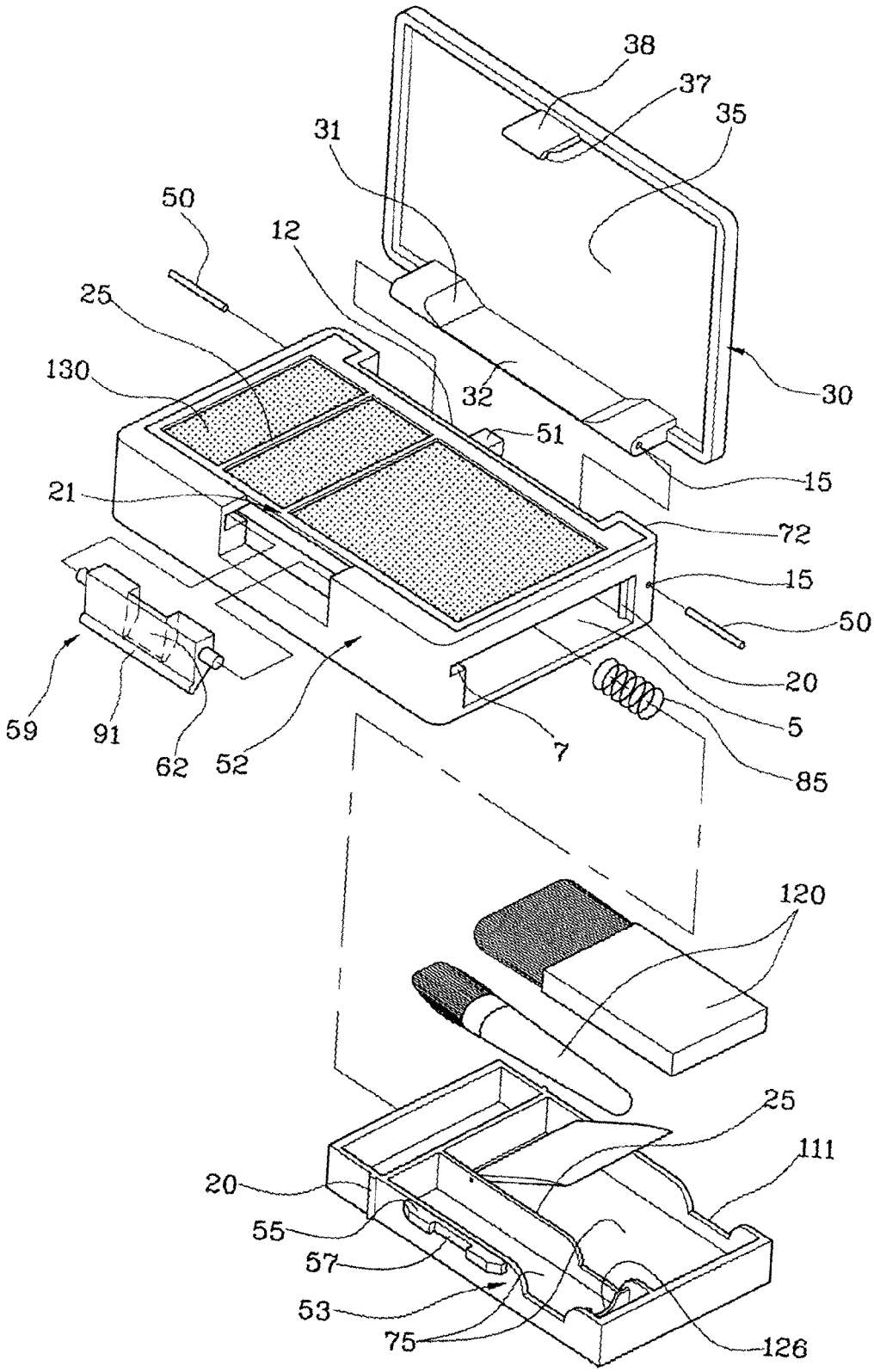
FIG. 3 is an exploded perspective view of a cosmetic case of button open type according to a second preferred embodiment of the present invention.
Figure 4:
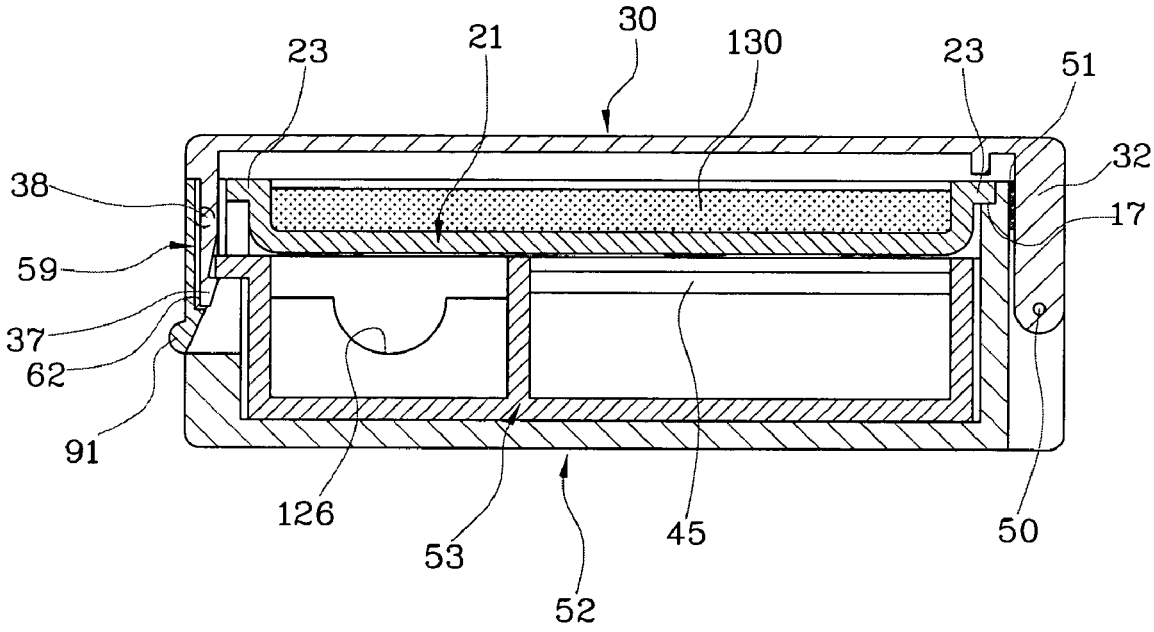
FIG. 4 is a horizontally sectional view of the cosmetic case of button open type according to the second embodiment of the present invention.

FIGS. 3 and 4 show the cosmetic case of button open type according to a second preferred embodiment of the present invention in detail. A main case 52 of the second embodiment is different from that of the first embodiment in that the main case 52 has a groove formed on the front surface for receiving a button panel 59. As in the first embodiment, a make-up case 21 is mounted on the main case 52, and hinge shafts 50 are mounted to hinge a cover 30 to the main case 52, and an elastic member 51 and a coil spring 85 are mounted on the main case 52.

A receiving drawer 53 sliding along an opening path 5 formed in a side portion 72 of the main case 52 is in the form of a rectangle, and includes partitions 25 for forming a receiving space 75 to receive and contain make-up tools, and a slider 55 formed on the outer side surface, inserted and slidably moving into a guide slot 7 of the main case 52 and having a locking groove 57. The slider 55 has a different shape of the slider 41 of the first embodiment.

A cover 30 covering the whole top portion of the main case 52 and rotatably opened is the same as the cover of the first embodiment. The cover 30 has a stopper 38 having a locking jaw 37, which is fastened to the lower end of the locking groove 57 formed in the slider 55 of the receiving drawer 40.

The button panel 59 hinged to the center of the main case 52 includes a protrusion 91 formed on the front surface and a push hole 62 for pushing up the stopper 38 by fitting and rotating the lower end of the stopper 38 so as to separate the locking jaw 37 from the locking groove 57 of the receiving drawer 40.

Figure 5:
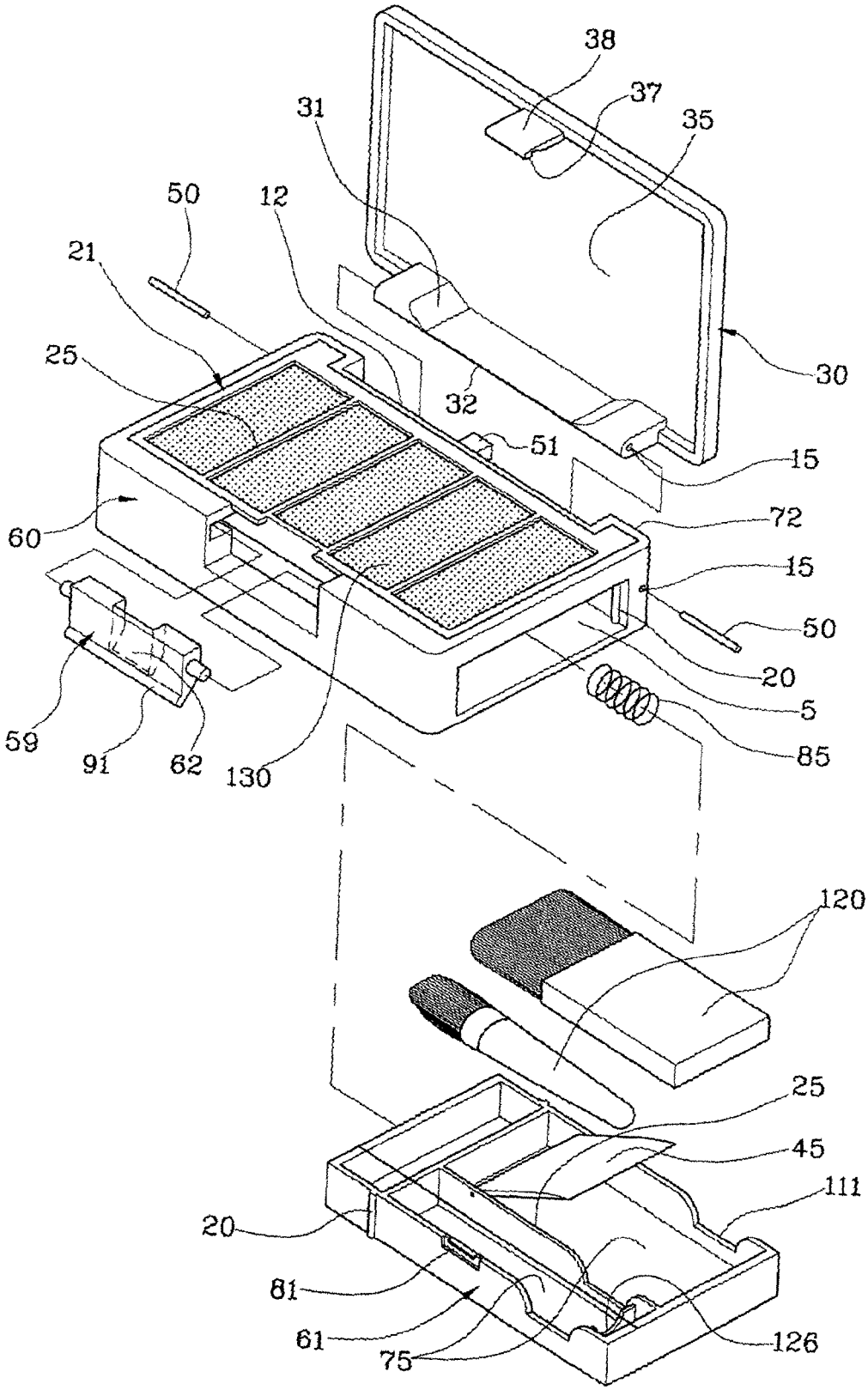
FIG. 5 is an exploded perspective view of a cosmetic case of button open type according to a third preferred embodiment of the present invention.
Figure 6:
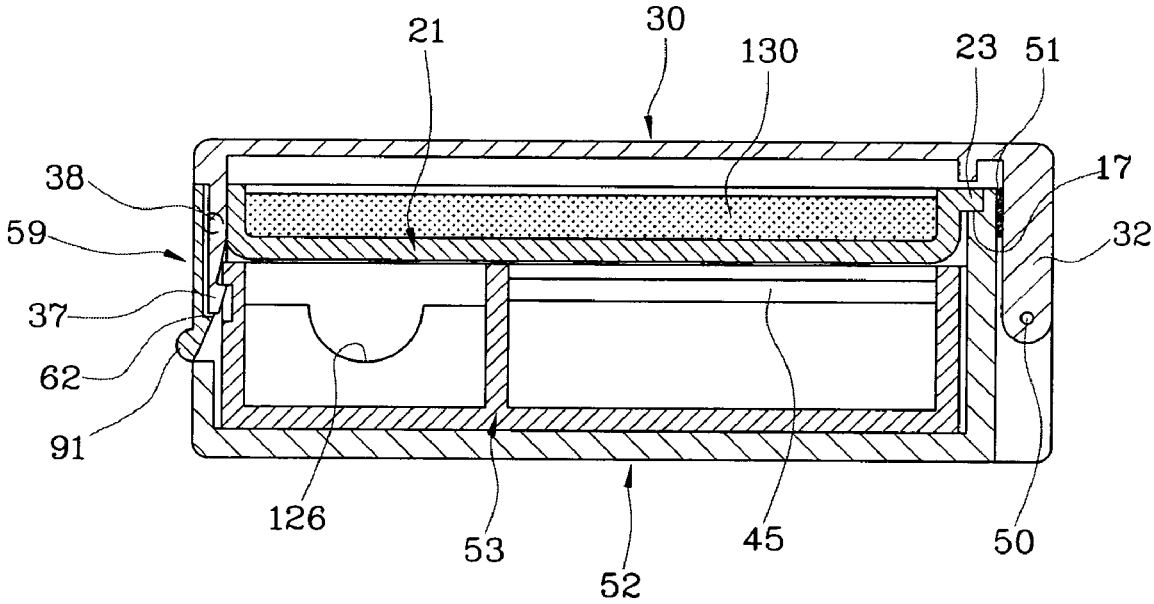
FIG. 6 is a horizontally sectional view of the cosmetic case of button open type according to the third embodiment of the present invention.

FIGS. 5 and 6 show another cosmetic case of button open type according to a third embodiment of the present invention. The third embodiment is different from the second embodiment in that a main case 60 does not have the guide slot 7 inside the main case 60. As in the second embodiment, a make-up case 21 is mounted on the main case 60, and hinge shafts 50 are mounted to hinge a cover 30 to the main case 60, an elastic member 51 and a coil spring 85 are mounted on the main case 60, the cover 30 is hinged to the main case 60, and a button panel 59 is hinged to the front surface of the main case 60.

A receiving drawer 61 sliding along an opening path 5 formed in the side portion of the main case 60 is in the form of a rectangle, and includes a fixing hole 81 corresponding to a locking jaw 37 formed in a stopper 38 of the cover to fix the cover 30.

Figure 7:
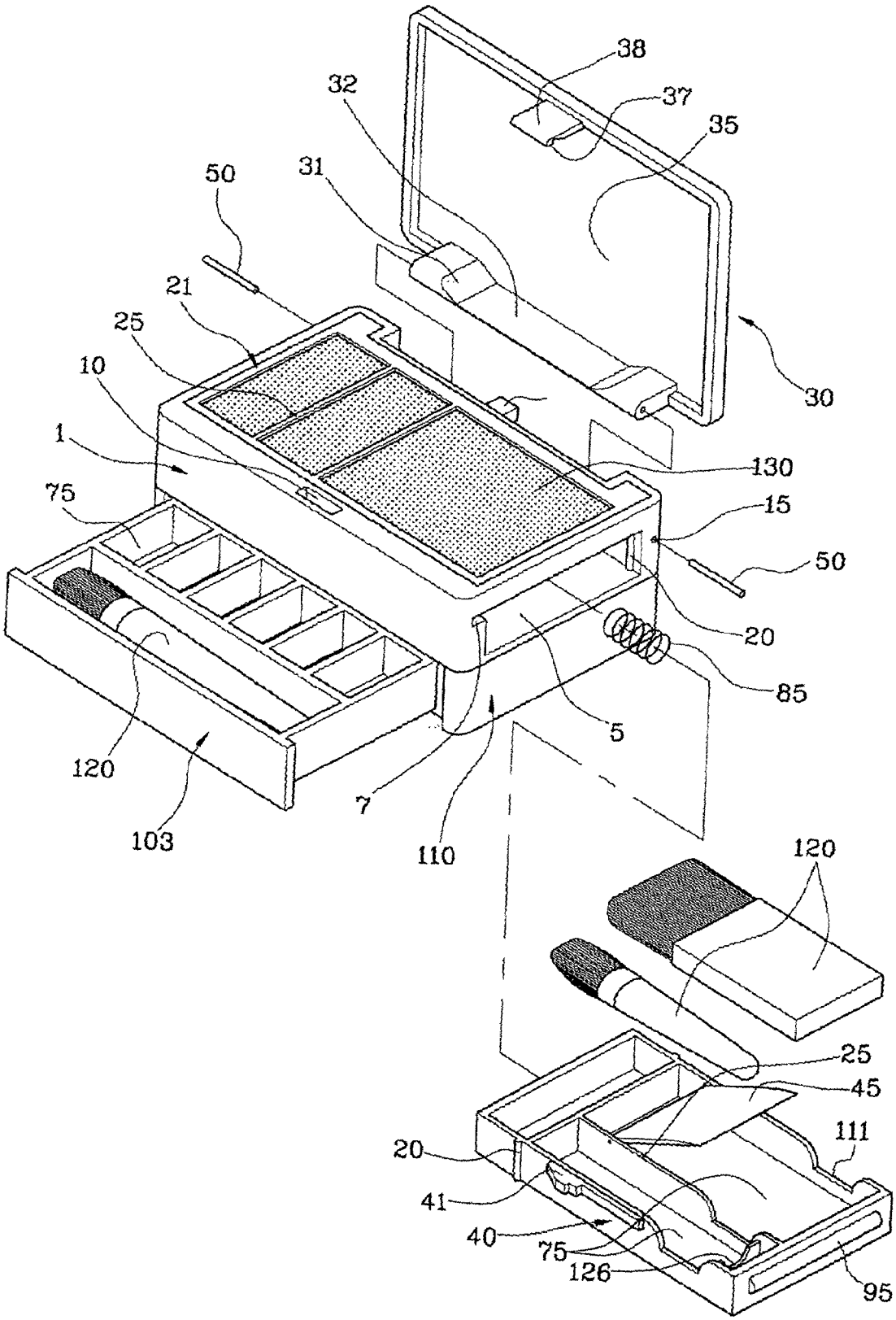
FIG. 7 is an exploded perspective view of a cosmetic case of button open type according to a fourth preferred embodiment of the present invention.
Figure 8:
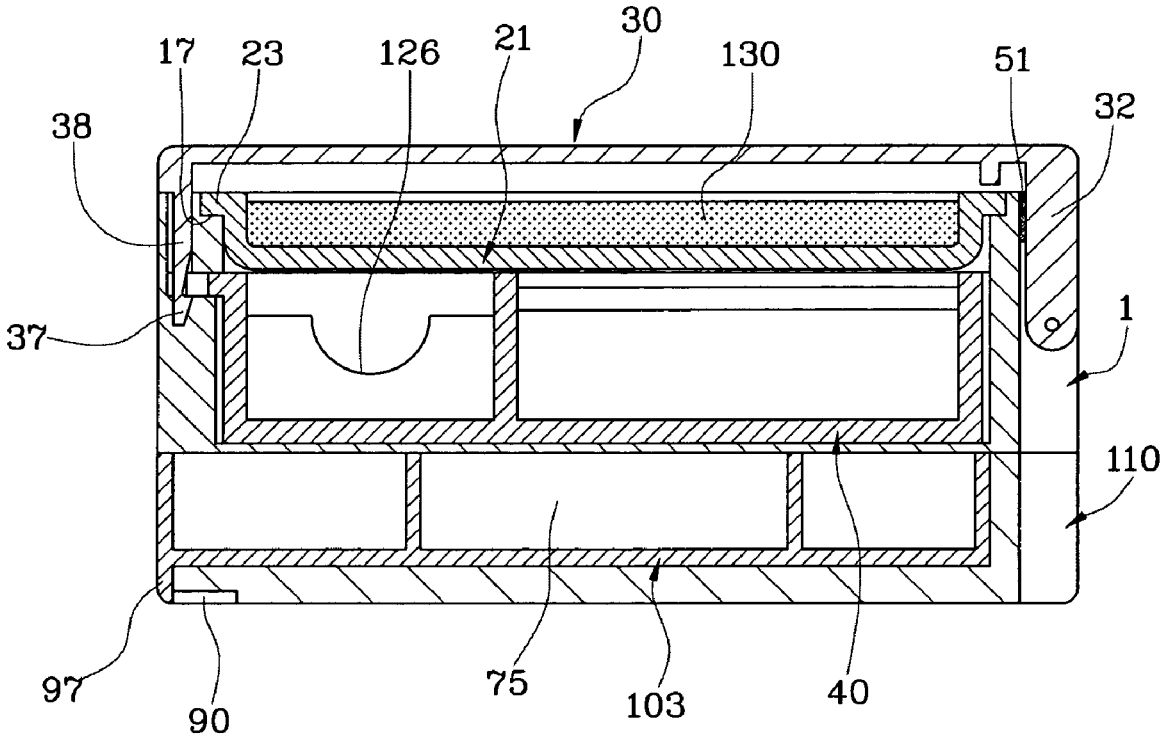
FIG. 8 is a horizontally sectional view of the cosmetic case of button open type according to the fourth embodiment of the present invention.

FIGS. 7 and 8 show a further cosmetic case of button open type according to a fourth preferred embodiment of the present invention. In the fourth embodiment, a subsidiary case 110 is mounted under the main case 1, 52 or 60 of the above embodiments to slidably move a subsidiary receiving drawer 103. The subsidiary case 110 is opened at the front, and has a semicircle hole 90 formed in the outer surface. The subsidiary receiving drawer 103 has receiving spaces 75 arranged in a line for receiving cosmetics 130 of various kinds and another receiving space 75 for receiving the brush 120, and an opening step 97 formed on the front surface for allowing the user to insert a finger into the semicircle hole 90 of the subsidiary case 110 and pull out the opening step 97. Furthermore, Protrusions are formed on both outer surfaces of the subsidiary receiving drawer 103 and both inner surfaces of the subsidiary case in the same way as the protrusions 20 of the receiving drawer 40, 53 and 61 of the above embodiments, and the protrusions are locking to the protrusion of the main case 1, 52 or 60.

Figure 9:
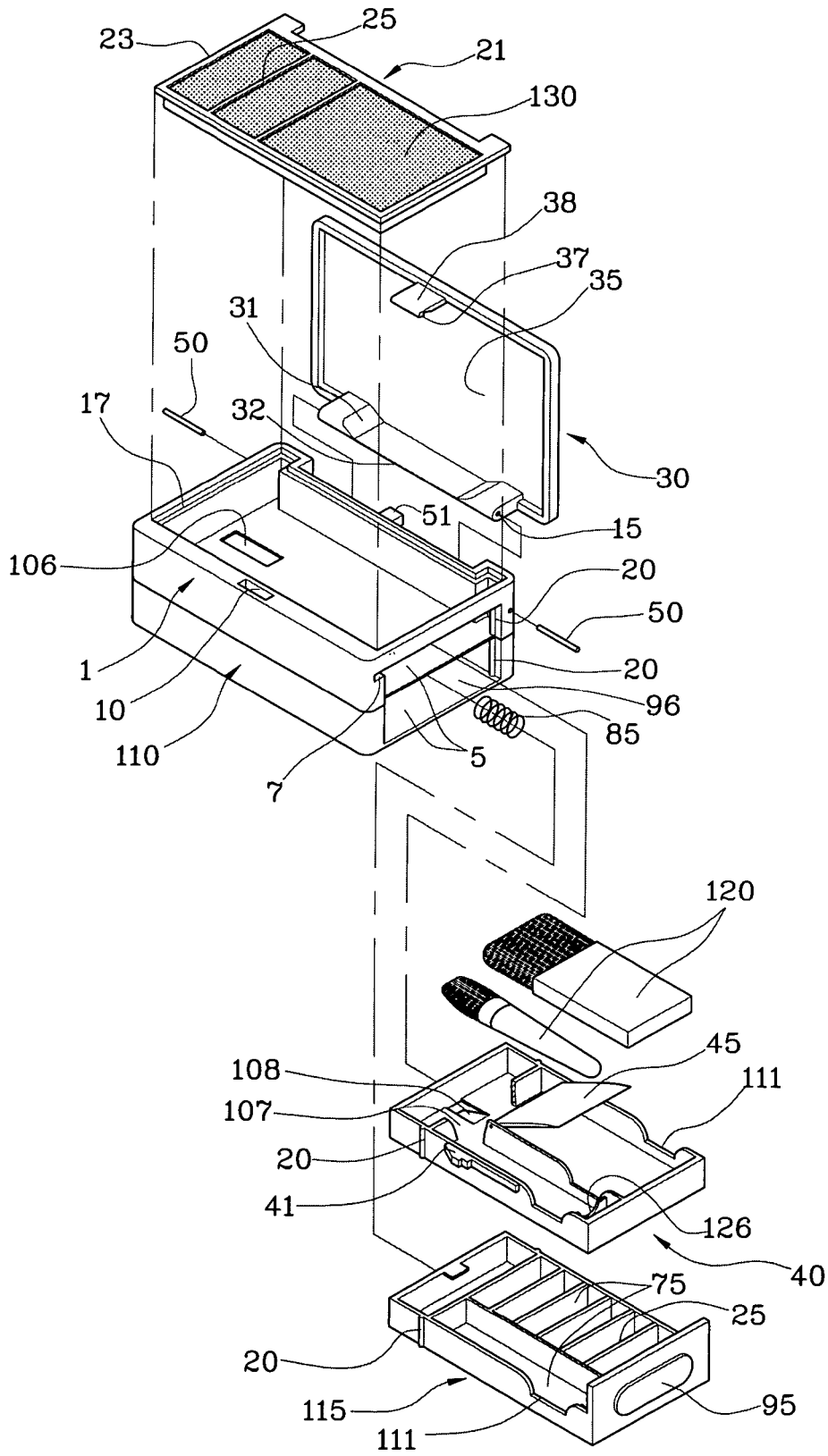
FIG. 9 is an exploded perspective view of a cosmetic case of button open type according to a fifth preferred embodiment of the present invention.
Figure 10:
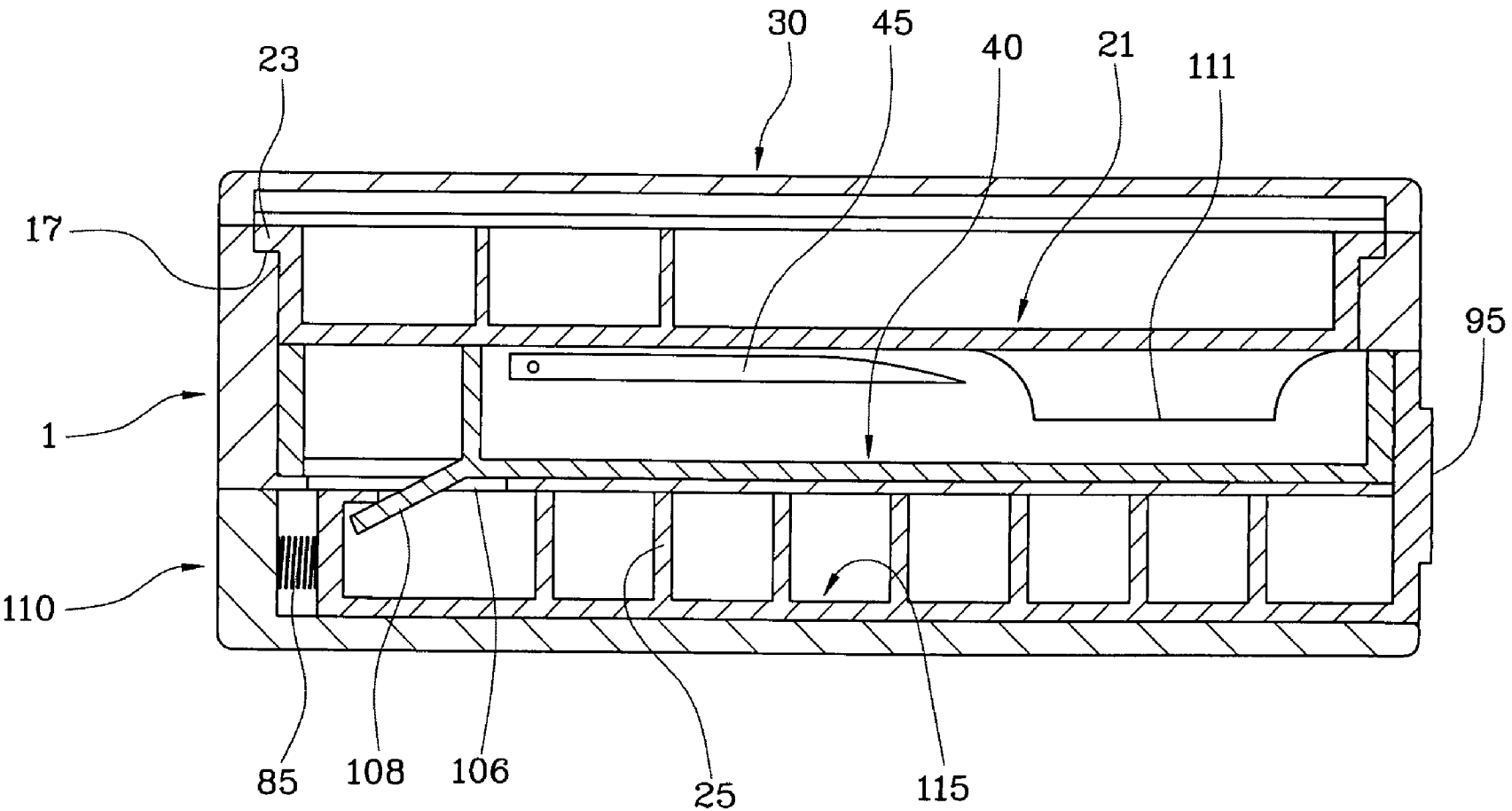
FIG. 10 is a vertically sectional view of the cosmetic case of button open type according to the fifth embodiment of the present invention.

FIGS. 9 and 10 show a still further cosmetic case of button open type according to a fifth preferred embodiment of the present invention. In the fifth embodiment, a subsidiary case 110 is mounted on the lower surface of the main case 1, 52 or 60 of the above embodiments, and has a subsidiary receiving drawer 115 moving in a laterally slidable manner. The subsidiary case 110 is fastened by a cover 30 as in the receiving drawer 40, 53 or 61.

The main case 1, 52 or 60 of the fifth embodiment has a hole 106 formed in the bottom board and communicating with the lower portion of the main case 1, 52 or 60, and a locking panel 108 is mounted on a bottom plate 107 of the receiving drawer 40, 53 or 61. The locking panel 108 is inserted into the hole 106 of the main case 1, 52 or 60 and protruding to the lower portion.

The subsidiary case 110 is connected to the lower surface of the main case 1, and has a space inside the subsidiary case 110 and an opening path 5 axially formed and having a protrusion 20 on a side surface.

The subsidiary receiving drawer 115 is seated on the space 96 formed by the subsidiary case 110 and slidably moving along the opening path 5. The subsidiary receiving drawer 115 is divided into two, and so, has a receiving space 75 axially arranged in a line and another receiving space 75 for receiving the brush 120. The subsidiary receiving drawer 115 includes semicircle protrusions 20 caught to protrusions 20 of the subsidiary case 110, a button 95 protruding from a side surface thereof, and a pickup hole 111 formed on the front board. The subsidiary receiving drawer 115 is supported by the locking panel 108 of the receiving drawer 40, 53 or 61 and restricted inside the space. Moreover, a coil spring 85 is mounted on the subsidiary case 110 to provide elasticity to the subsidiary receiving drawer 115. Meanwhile, it is preferable to mount a mirror(not shown) on a cover plate of a cover.

Hereinafter, the locked and released actions between the cover 30 and the receiving drawer 40, 53 or 61 according to the embodiments of the present invention will be described in more detail.

In the first embodiment of the present invention, when the user pushes the button 95 of the receiving drawer 40, the locking of the locking jaw 37 of the stopper 38 is released from the cover stop step 43 of the receiving drawer 40, and the cover 30 is rotated and lifted up by the elastic member 51 mounted on the outer surface of the main case 1. When the locking of the sliding stop step 42 of the receiving drawer 40 is released from the side surface of the stopper 38, the receiving drawer 40 is bounced out of the main case 1 by the coil spring 85 mounted on the side surface thereof. After all, the cover 30 is rotated and exposes the make-up case 21 to the outside, and the receiving drawer 40 is pushed in a lateral direction, and exposes the make-up brush 120 and a pencil loaded on the receiving drawer 40. In this condition, the user can use the cosmetics 130 put in the make-up case 21 using the make-up brush 120 and a pencil. After the make-up, when the user pushes the receiving drawer 40 into the main case 1 and closes the cover 30, the locking jaw 37 formed on the stopper 38 of the cover 30 is locked to the cover stop step 43 of the slider 41 of the receiving drawer 40, and at the same time, the side surface of the stopper 38 is locked to the sliding stop step 42, so that the cover 30 and the receiving drawer 40 are fastened to the main case 1 at the same time.

Differently from the first embodiment, in the second embodiment, the locking jaw 37 formed on the stopper 38 of the cover 30 is locked to the lower surface of the locking groove 57 formed in the slider 55 of the receiving 53 under the state in which the receiving drawer 53 is completely inserted into the opening path 5 of the main case 52, and thereby, the cover 30 covers the top portion of the main case 1. At this time, when the user pushes the protrusion 91 of the button panel 59 hinged to the front surface of the main case 1, the button panel 59 is rotated and the push hole 62 formed in the button panel 59 pushes up the locking jaw 37 of the stopper 38 from the lower portion of the locking groove 57 of the slider 55, so that the fastened state between the cover 30 and the receiving drawer 53 is removed. The cover 30 is rotated and opened by the elastic member 51, and the receiving drawer 53 is exposed to the outside of the main case 52 by the coil spring 85.

In the third embodiment, the locking jaw 37 of the cover 30 is fastened to the locking groove 81 of the receiving drawer 61, the cover 30 is opened and the receiving drawer 61 protrudes to the outside when the user pushes the button panel 59.

In the fourth embodiment, the subsidiary receiving drawer 103 appeared from and disappeared into the space 96 is provided inside the space 96 formed under the main case 1, 52 or 60. The subsidiary receiving drawer 103 allows the user to put the cosmetics 130 of various kinds into the cosmetic case, so that the user can apply make-up in various ways.

In the fifth embodiment, the subsidiary receiving drawer 115, which is exposed to the outside together with the receiving drawer 40, 53 or 61 by the coil spring 85 mounted on the lower portion of the main case 1, 52 or 60. When the outer side end of the subsidiary receiving drawer 115 pushes the receiving drawer 40, 53 or 61 and inserted into the main case 1, if the cover 30 of the above embodiments is fastened to the main case 1, 52 or 60 by applying fixing members, which fix the cover 30 to the receiving drawer 40, 53 or 61, to the subsidiary receiving drawer 115 as it is, the cover 30 is fixed to the main case 1, 52 or 60. By the fixing members, the locking panel 108 of the receiving drawer 40, 53 or 61 inserted into the hole 106 of the main case 1, 52 or 60 supports the inner end of the subsidiary receiving drawer 115, and the subsidiary receiving drawer 115 goes into the receiving drawer while pushing the receiving drawer 40, 53 or 61. Thereby, the subsidiary receiving drawer 115 is fixed to the inside of the main case 1, 52 or 60. To the contrary, when the user pushes the button 95 of the subsidiary receiving panel 115 or the button panel 59 hinged to the main case 1, 52 or 60, by releasing members for releasing the fastened state of the cover 30, the cover 30 is rotated by elasticity of the elastic member 51, and the subsidiary receiving drawer 115 is exposed while pushing the locking panel 108 of the receiving drawer 40, 53 or 61 to the outside by the coil spring 85. After all, the cover 30 exposes the make-up case 21, and the receiving drawer 40, 53 or 61 and the subsidiary receiving drawer 115 are exposed at the same time.

According to the present invention, when the user pushes the button formed on the front portion or the side surface, the cover and the receiving drawer are simultaneously opened, and thereby, the cosmetic case of button open type can provide the user with convenience, sufficiently secure the receiving space for the color tone cosmetics and make-up tools of various kinds, and provide convenience in carrying along with it by coupling the receiving drawer and the case compactly.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A cosmetic case comprising:

a main case comprising an integrated board and so constructed and arranged that when the lower portion is closed and the upper portion is opened, the main case having an opening path formed on a side surface, a horizontally straight guide slot formed in a front surface of the inside thereof, a locking groove formed in an upper surface of the board, which is the front surface of the main case, so as to be vertically connected with the guide slot, a coupling groove recessed inwardly from the central portion of a plate, which is the rear surface of the inside, shaft holes formed in both sides of the side portions, and a seating step formed on the upper surface of the board surrounding the all directions;

a make-up case having a flange corresponding to the shape of the seating step of the main case, and partitions formed integrally with the flange for receiving cosmetics of various kinds;

a cover having shaft holes to be hinged with the shaft holes of the main case, a coupling plate corresponding to the coupling groove of the main case, the coupling plate having a concave portion formed on the center and having inclined surfaces formed on both sides, a cover plate being at a right angle to the coupling plate, and a stopper being at a right angle to the cover plate and fit into the locking groove of the main case, the stopper having a locking jaw formed on the lower end thereof;

a receiving drawer of a rectangular drawer type, the receiving drawer having partitions for forming a receiving space to receive make-up tools, a sliding stop step slidably inserted into the guide slot of the main case and caught to the side surface of the stopper, and a slider mounted on the outer side surface and having a cover stop step for locking the locking jaw of the stopper;

hinge shafts inserted into the shaft holes of the side portions of the main case and the shaft holes of both sides of the coupling plate of the cover for hinging the cover to the main case;

an elastic member mounted on an outer surface of the main case, the elastic member being elastically compressed by the concave portion of the coupling plate of the cover to rotate and open the cover when a user pushes a button; and a coil spring for providing elasticity between the inner surface of the main case and the side surface of the receiving drawer so that the receiving drawer can be moved out of the main case.

2. The cosmetic case of claim 1, wherein the receiving drawer has a receiving cover hinged to the partition and the upper portion of the side board to open and close a part of the receiving space.

3. The cosmetic case of claim 1, wherein the partition and the side board forming the receiving space of the receiving drawer respectively have pickup grooves for allowing a user to easily pick up make-up tools, and the receiving space has a semicircle hole to put a rounded article.

4. The cosmetic case of claim 1, wherein the main case has protrusions formed on both sides of the opening path, and the receiving drawer has semicircle protrusions formed on both outer sides of the receiving drawer to be locked to the protrusions formed on the main case.

5. The cosmetic case of claim 1, wherein the cover plate of the cover has a mirror.

6. A cosmetic case comprising:

a main case comprising an integrated board case surrounding all directions so that the lower portion is closed and the upper portion is opened, the main case having an opening path formed on a side surface, a horizontally straight guide slot formed in the front surface of the inside thereof a coupling groove recessed inwardly from the central portion of the board, which is the rear surface of the inside, shaft holes formed in both sides of the side portions, and a seating step formed on the upper surface of the board surrounding the all directions;

a make-up case having a flange corresponding to the shape of the seating step of the main case, and partitions formed integrally with the flange for receiving cosmetics of various kinds;

a receiving drawer of a rectangular drawer type, the receiving drawer having partitions for forming a receiving space to receive make-up tools, and a slider formed on the outer side surface and slidably moveable when the slider is inserted into the guide slot of the main case, the slider having a locking groove;

a cover having shaft holes to be hinged with the shaft holes of the main case, a coupling plate corresponding to the coupling groove of the main case, the coupling plate having a concave portion formed on a center and having inclined surfaces formed on both sides, a cover plate located at a right angle to the coupling plate and having the protruding circumference, and a stopper located at a right angle to the cover plate, the stopper having a locking jaw to be fixed to the lower end of the locking groove of the receiving drawer;

a button panel hinged to the center of the main case, the button panel having a protrusion formed on the front surface and a push hole formed in the rear surface, the lower end of the stopper being inserted into the push hole, the push hole pushing up the stopper by rotation to separate the stopper from the locking groove of the receiving drawer;

hinge shafts inserted into the shaft holes of the side portions of the main case and the shaft holes of both sides of the coupling plate of the cover for hinging the cover to the main case;

an elastic member mounted on the outer surface of the main case to rotate and open the cover, the elastic member being elastically compressed by the concave portion of the coupling plate of the cover; and a coil spring for providing elasticity between the inner surface of the main case and the side surface of the receiving drawer so that the receiving drawer can be moved out of the main case.

7. The cosmetic case of claim 6, wherein a subsidiary case opened at the front is mounted under the main case, the subsidiary case having protrusions formed on the inner side surfaces and a rounded groove formed on the outer surface, the subsidiary case including a receiving space divided by partitions to contain cosmetics and brushes of various kinds, an opening step formed on the front surface for allowing the user to easily pull out the subsidiary case with a hand, and a subsidiary receiving drawer slidably moving inside the subsidiary case and having protrusions locked to the protrusions of the subsidiary case.

8. The cosmetic case of claim 6, further comprising:

a hole formed in the bottom surface of the main case to communicate with the lower portion of the main case;

a locking panel formed on the bottom board of the receiving drawer, the locking panel being inserted into the hole of the main case and protruding downwardly;

a subsidiary case connected to the lower surface of the main case, the subsidiary case having an inner space and an opening path formed axially and having protrusions on the side surfaces;

a subsidiary receiving drawer seated inside the space of the subsidiary case and slidably moving along the opening path, the subsidiary receiving drawer having a receiving space divided by partitions so as to have receiving spaces axially arranged in a line and another receiving space for receiving a brush, semicircle protrusions to be locked to the protrusions of the subsidiary case, a button protruding from the side surface, and a pickup groove formed in the front board, the subsidiary receiving drawer being supported to the locking panel of the receiving drawer and restricted inside the space of the subsidiary case; and a coil spring mounted on the side surface of the subsidiary receiving drawer to provide elasticity so that the subsidiary receiving drawer is bounced to the outside together with the receiving drawer.

9. The cosmetic case of claim 6, wherein the receiving drawer has a receiving cover hinged to the partition and the upper portion of the side board to open and close a part of the receiving space.

10. The cosmetic case of claim 6, wherein the partition and the side board forming the receiving space of the receiving drawer respectively have pickup grooves for allowing a user to easily pick up make-up tools, and the receiving space has a semicircle hole to put a rounded article.

11. The cosmetic case of claim 6, wherein the main case has protrusions formed on both sides of the opening path, and the receiving drawer has semicircle protrusions formed on both outer sides of the receiving drawer to be locked to the protrusions formed on the main case.

12. The cosmetic case of claim 6, wherein the cover plate of the cover has a mirror.

13. A cosmetic case comprising:

a main case made of an integrated board case surrounding all directions so that the lower portion is closed and the upper portion is opened, the main case having an opening path formed in a side surface, a coupling groove recessed inwardly from the central portion of the board, which is the rear surface of the inside, shaft holes formed in both sides of the side portions, and a seating step formed on the upper surface of the board surrounding the all directions;

a cover having shaft holes to be hinged with the shaft holes of the main case, a coupling plate corresponding to the coupling groove of the main case, the coupling plate having a concave portion formed on the center and having inclined surfaces formed on both sides, a cover plate located at a right angle to the coupling plate and having the protruding circumference, and a stopper being at a right angle to the cover plate and having a locking jaw;

a make-up case having a flange corresponding to the shape of the seating step of the main case, and partitions formed integrally with the flange for receiving cosmetics of various kinds;

a receiving drawer comprising board, the receiving drawer having partitions for forming a receiving space to receive make-up tools, and a locking groove formed on the side surface for fixing the cover by fitting the locking jaw of the stopper of the cover into the locking groove;

a button panel hinged to the center of the main case, the button panel having a protrusion formed on the front surface and a push hole formed in the rear surface, the lower end of the stopper being inserted into the push hole, the push hole pushing up the stopper by rotation to separate the stopper from the locking groove of the receiving drawer;

hinge shafts inserted into the shaft holes of the side portions of the main case and the shaft holes of both sides of the coupling plate of the cover for hinging the cover to the main case; and a coil spring for providing elasticity between the inner surface of the main case and the side surface of the receiving drawer so that the receiving drawer can be moved out of the main case.

14. The cosmetic case of claim 13, wherein a subsidiary case opened at the front is mounted under the main case, the subsidiary case having protrusions formed on the inner side surfaces and a rounded groove formed on the outer surface, the subsidiary case including a receiving space divided by partitions to contain cosmetics and brushes of various kinds, an opening step formed on the front surface for allowing the user to easily pull out the subsidiary case with a hand, and a subsidiary receiving drawer slidably moving inside the subsidiary case and having protrusions locked to the protrusions of the subsidiary case.

15. The cosmetic case of claim 13, further comprising:

a hole formed in the bottom surface of the main case to communicate with the lower portion of the main case;

a locking panel formed on the bottom board of the receiving drawer, the locking panel being inserted into the hole of the main case and protruding downwardly;

a subsidiary case connected to the lower surface of the main case, the subsidiary case having an inner space and an opening path formed axially and having protrusions on the side surfaces;

a subsidiary receiving drawer seated inside the space of the subsidiary case and slidably moving along the opening path, the subsidiary receiving drawer having a receiving space divided by partitions so as to have receiving spaces axially arranged in a line and another receiving space for receiving a brush, semicircle protrusions to be locked to the protrusions of the subsidiary case, a button protruding from the side surface, and a pickup groove formed in the front board, the subsidiary receiving drawer being supported to the locking panel of the receiving drawer and restricted inside the space of the subsidiary case; and a coil spring mounted on the side surface of the subsidiary receiving drawer to provide elasticity so that the subsidiary receiving drawer is bounced to the outside together with the receiving drawer.

16. The cosmetic case of claim 13, wherein the receiving drawer has a receiving cover hinged to the partition and the upper portion of the side board to open and close a part of the receiving space.

17. The cosmetic case of claim 13, wherein the partition and the side board forming the receiving space of the receiving drawer respectively have pickup grooves for allowing a user to easily pick up make-up tools, and the receiving space has a semicircle hole to put a rounded article.

18. The cosmetic case of claim 13, wherein the main case has protrusions formed on both sides of the opening path, and the receiving drawer has semicircle protrusions formed on both outer sides of the receiving drawer to be locked to the protrusions formed on the main case.

19. The cosmetic case of claim 13, wherein the cover plate of the cover has a mirror.

20. A cosmetic case comprising:

a main case comprising an integrated board and so constructed and arranged that when the lower portion is closed and the upper portion is opened, the main case having an opening path formed on a side surface, a horizontally straight guide slot formed in a front surface of the inside thereof, a locking groove formed in an upper surface of the board, which is the front surface of the main case, so as to be vertically connected with the guide slot, a coupling groove recessed inwardly from the central portion of a plate, which is the rear surface of the inside, shaft holes formed in both sides of the side portions, and a seating step formed on the upper surface of the board surrounding the all directions;

a subsidiary case opened at the front mounted under the main case, the subsidiary case having protrusions formed on the inner side surfaces and a rounded groove formed on the outer surface, the subsidiary case including a receiving space divided by partitions to contain cosmetics and brushes of various kinds, an opening step formed on the front surface for allowing the user to easily pull out the subsidiary case with a hand, and a subsidiary receiving drawer slidably moving inside the subsidiary case and having protrusions locked to the protrusions of the subsidiary case;

a make-up case having a flange corresponding to the shape of the seating step of the main case, and partitions formed integrally with the flange for receiving cosmetics of various kinds;

a cover having shaft holes to be hinged with the shaft holes of the main case, a coupling plate corresponding to the coupling groove of the main case, the coupling plate having a concave portion formed on the center and having inclined surfaces formed on both sides, a cover plate being at a right angle to the coupling plate, and a stopper being at a right angle to the cover plate and fit into the locking groove of the main case, the stopper having a locking jaw formed on the lower end thereof;

a receiving drawer of a rectangular drawer type, the receiving drawer having partitions for forming a receiving space to receive make-up tools, a sliding stop step slidably inserted into the guide slot of the main case and caught to the side surface of the stopper, and a slider mounted on the outer side surface and having a cover stop step for locking the locking jaw of the stopper;

hinge shafts inserted into the shaft holes of the side portions of the main case and the shaft holes of both sides of the coupling plate of the cover for hinging the cover to the main case;

an elastic member mounted on an outer surface of the main case, the elastic member being elastically compressed by the concave portion of the coupling plate of the cover to rotate and open the cover when a user pushes a button; and a coil spring for providing elasticity between the inner surface of the main case and the side surface of the receiving drawer so that the receiving drawer can be moved out of the main case.

21. A cosmetic case comprising:

a main case comprising an integrated board and so constructed and arranged that when the lower portion is closed and the upper portion is opened, the main case having an opening path formed on a side surface, a horizontally straight guide slot formed in a front surface of the inside thereof, a locking groove formed in an upper surface of the board, which is the front surface of the main case, so as to be vertically connected with the guide slot, a coupling groove recessed inwardly from the central portion of a plate, which is the rear surface of the inside, shaft holes formed in both sides of the side portions, and a seating step formed on the upper surface of the board surrounding the all directions;

a make-up case having a flange corresponding to the shape of the seating step of the main case, and partitions formed integrally with the flange for receiving cosmetics of various kinds;

a cover having shaft holes to be hinged with the shaft holes of the main case, a coupling plate corresponding to the coupling groove of the main case, the coupling plate having a concave portion formed on the center and having inclined surfaces formed on both sides, a cover plate being at a right angle to the coupling plate, and a stopper being at a right angle to the cover plate and fit into the locking groove of the main case, the stopper having a locking jaw formed on the lower end thereof;

a receiving drawer of a rectangular drawer type, the receiving drawer having partitions for forming a receiving space to receive make-up tools, a sliding stop step slidably inserted into the guide slot of the main case and caught to the side surface of the stopper, and a slider mounted on the outer side surface and having a cover stop step for locking the locking jaw of the stopper;

hinge shafts inserted into the shaft holes of the side portions of the main case and the shaft holes of both sides of the coupling plate of the cover for hinging the cover to the main case;

an elastic member mounted on an outer surface of the main case, the elastic member being elastically compressed by the concave portion of the coupling plate of the cover to rotate and open the cover when a user pushes a button;

a coil spring for providing elasticity between the inner surface of the main case and the side surface of the receiving drawer so that the receiving drawer can be moved out of the main case;

a hole formed in the bottom surface of the main case to communicate with the lower portion of the main case;

a locking panel formed on the bottom board of the receiving drawer, the locking panel being inserted into the hole of the main case and protruding downwardly;

a subsidiary case connected to the lower surface of the main case, the subsidiary case having an inner space and an opening path formed axially and having protrusions on the side surfaces; and a subsidiary receiving drawer seated inside the space of the subsidiary case and slidably moving along the opening path, the subsidiary receiving drawer having a receiving space divided by partitions so as to have receiving spaces axially arranged in a line and another receiving space for receiving a brush, semicircle protrusions to be locked to the protrusions of the subsidiary case, a button protruding from the side surface, and a pickup groove formed in the front board, the subsidiary receiving drawer being supported to the locking panel of the receiving drawer and restricted inside the space of the subsidiary case.

* * * * *